United States Patent [19]

Thatcher

[11] Patent Number: 4,793,075

[45] Date of Patent: Dec. 27, 1988

[54] SPORT SANDAL FOR ACTIVE WEAR

[76] Inventor: Mark Thatcher, Box 968, Flagstaff, Ariz. 86002

[21] Appl. No.: 96,914

[22] Filed: Sep. 15, 1987

[51] Int. Cl.[4] ..... A43B 3/12

[52] U.S. Cl. ..... 36/11.5; 36/50; 36/58.5; 12/142 S

[58] Field of Search ..... 36/11.5, 7.5, 58.5, 36/50; 12/142 S; 2/DIG. 6

[56] References Cited

U.S. PATENT DOCUMENTS

| | | | |
|---|---|---|---|
| 950,862 | 3/1910 | Nelson | 36/58.5 |
| 1,652,354 | 12/1927 | Grubs | 36/58.5 |
| 4,079,527 | 3/1978 | Antonious | 36/50 X |
| 4,275,512 | 6/1981 | Zeligman et al. | 36/11.5 |
| 4,677,767 | 7/1987 | Darby | 36/11.5 X |

FOREIGN PATENT DOCUMENTS

| | | | |
|---|---|---|---|
| 349631 | 6/1937 | Italy | 36/11.5 |
| 77921 | 6/1918 | Switzerland | 36/11.5 |

*Primary Examiner*—James Kee Chi

*Attorney, Agent, or Firm*—Joseph L. Strabala

[57] ABSTRACT

A sandal with an elongated sole configured to the profile of a human footprint with a toe end and a heel end, employs a toe strap connected at two anchor points to grip the forward part of user's foot and a heel strap connected at two anchor points to grip the ankle of a user's foot with a lateral strap connected between the toe strap and the heel strap which is located on the outside of the sole and parallel to its surface so it is operable to stabilize the other straps and to maintain essentially constant tension in the individual straps as the sole flexes, with the toe and heel straps being infinitely adjustable so the wearer can cinch the sandal to his foot by adjusting said straps in a manner that it will not be dislodged during rigorous activity.

3 Claims, 1 Drawing Sheet

SPORT SANDAL FOR ACTIVE WEAR

BACKGROUND OF THE INVENTION

In many sporting activities, such as white water river rafting, the enthusiasts prefer to wear sandals. However, such comfortable foot wear is often more of a menace than a help because they are lost at inopportune times, leaving the wearer without a protective sole between his feet and a rocky river bottom or can dangerously entangled a wearer in his partially dislodged footware leading to injury.

Typical sandals are totally unsuitable for such sporting activities, such as surfing, swimming and running, where the performance of the retention mechanism is critical in retaining the sandal on the wearer's foot during his rigorous activity.

With more focus on physical fitness of the general population a great deal of interest had developed in sport sandals. Sandals with extensive lacing from side to side across the sole and around the ankle do measure up to the requirements for footwear used by sports enthusiasts, but they are usually highly uncomfortable and difficult to lace properly as well as requiring arduous patience for this time consuming task.

Applicant earlier developed a sandal design which overcame many of the problems with the lace type sandals; it is disclosed in U.S. Pat. No. 4,584,782 issued to Thatcher on Apr. 29, 1986. Shortly after its introduction it was well received by sports enthusiasts and gained a substantial and immediate market share. It was a vast improvement over the prior art sandals, such as those shown in U.S. Pat. Nos. 2,642,677 issued to Yates, 4,051,610 issued to Shigeji and 4,200,997 issued to Scheinhaue et al.

However a draw back with Applicant's patented sandal was many users did not like its retention strap or post positioned between the toes which some times caused chaffing during very vigorous sport activities. Also a common complaint is that it is difficult to wear socks with the patent sandals unless the socks were specially constructed with a "V" between the big toe and the next one.

Applicant has now found by using an anchoring system with infinitely adjustable straps and a cross strap across the base of the toes connected to the heel straps with a lateral strap positioned along the outside of the foot connecting the toe strap and heel straps systems, the retention requirements of sandal for those engaged in rigorous sport activities can be met without any loss of comfort.

Further the novel sandal is easy to slip into and out of once it is cinched properly by merely opening the instep strap and is completely adjustable to any wearer's foot.

SUMMARY OF THE INVENTION

The current invention is a sport sandal including an elongated sole configured to the profile of a human foot having a toe end and a heel end, a tether strap system connected to the top of said sole for retaining a human foot, the tether strap system having a toe strap system extending transversely of the sole adjacent to the toe end and a heel strap system connected to the sole at the heel end for encircling a user's ankle and a lateral strap connected between said toe strap system and said heel strap system with the lateral strap located parallel to and an along the outer edge of the sole so flexing of said sole will not appreciably change the tension in said tether strap system.

BRIEF DESCRIPTION OF THE DRAWINGS

The invention will be better understood by reference to the attached drawings in conjunction with the Description herein wherein.

DESCRIPTION OF A PREFERRED EMBODIMENT

Figure 1:
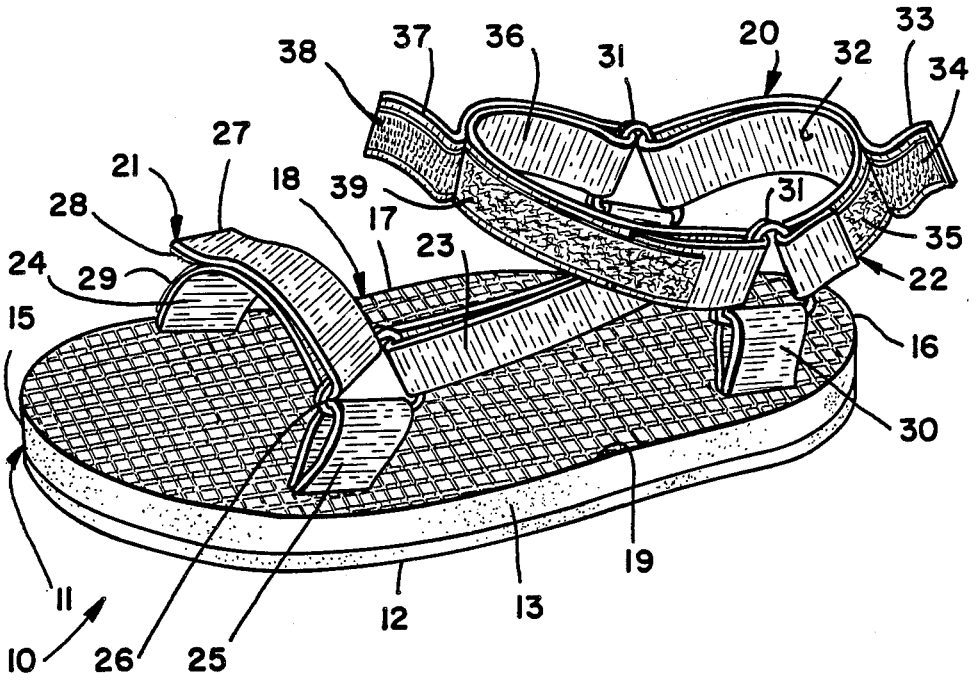
FIG. 1 is a perspective of the novel sandal illustrating the components of the device.

The novel sandal 10 of this invention can be better understood by reference to FIG. 1. It includes a sole 11 which is configured to the profile of a human foot. It has a three part construction, having a outsole 12 laminated to an insole 13 with a wedge shaped arch insert [not shown] centrally positioned between the toe end 15 and the heel end 16 of the sandal sole. The raised arch 17 is formed by the wedge insert along the inside edge 18 of the sole, opposite the outside edge 19 of the sole.

In many respects the sole 11 is typical of those found in sandals with the outside 13 having various treads patterns [not shown] suitable for the application for which the sandal is designed. Regardless of the tread design, all of the novel sandals of this invention have a novel tether strap system 20 to comfortably retain it on a wearer's foot. This system is typically made of a soft, non stretchable nylon webbing and is specially constructed so that articulation of the foot will not allow the system to loosen during rigorous sport activities.

Figure 2:
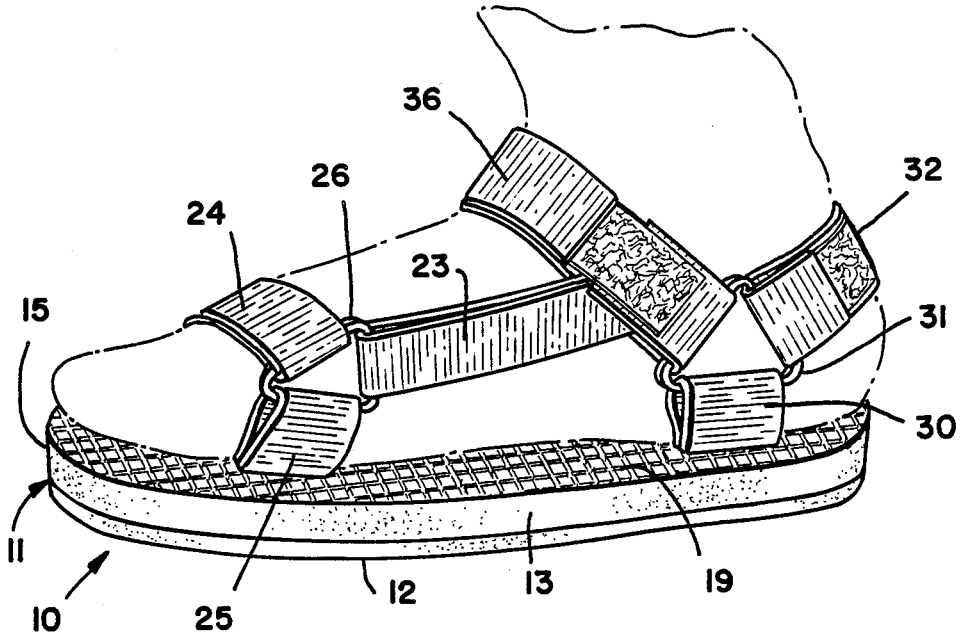
FIG. 2 is a elevation of the novel sandal illustrating a human foot in phantom showing how a wearer secures the sandal to his foot.

More particularly, the tether strap system 20 is composed of two units, which are the toe strap unit 21, which portion which secures the sandal 10 to the forward part of the foot and the heel strap unit 22, which is that portion which secures the sandal to the heel and ankle of the foot. These two units are connected by a tether strap or lateral strap 23 which runs parallel to the outside edge 19 of the sandal as can be seen in FIGS. 1 and 2. This lateral strap is one of the keys to the operation of the tether strap system and its location, slightly above the outer edge and parallel thereto is critical to the desired performance of the sandal.

The toe strap unit 21 includes a toe strap 24 which is connected adjacent to the inside edge 18 of the sole 11 near the toe end 15 of the sandal 10. It emerges form the insole in a position so this toe strap will cradle the forward part of the ball of the wearer's foot, i.e., the joint between the 1st metatorsal and its connected phalange [big toe bone]. Part of the toe strap 24 is cross-threaded between the outsole 12 and the insole 13, as shown by the broken lines in FIG. 1, and forms the toe post 25. This toe post also emerges from the insole near the toe end, but is located on the sole aft of the location where the toe strap emerges from the insole along the inside edge 18. Generally its location is such that it cradles the little toe of the wearer's foot as the toe strap is tightened.

The toe post 25 extends about an inch above the top of the insole 13 and terminates in a D-ring 26, which could be any type of a ring that will allow the several straps connected to the ring to pivot when the tether strap system 20 is cinched on the wearer's foot. The distal end 27 of the toe strap 24 is threaded through the D-ring as shown in FIG. 1 and looped back against itself. Between the surfaces of this strap are hook and loop fasteners, such as those commonly sold as VELCRO~. More particularly, patches of marine quality YKK~ loop and hook fasteners employed, with an elongated hook patch 28 sewn to the distal end of this strap and a loop patch 29 sewn to the central portion of this strap. It can be appreciated that by pulling on the distal end of the toe strap it can be cinched across the top of the wearer's foot when the two patches are brought in contact.

Also connected to the D-ring 26 is the lateral strap 23 as can be seen best in FIG. 1. This strap holds the D-ring aft [toward the heel end 16] so it is displaced angularly from the connection of the toe post to the insole 13. Thus cinching the toe strap will tension the strap system 20 in a tripod configuration as disclosed in FIG. 2 where the toe post wraps over the little toe and into the instep of a wearer's foot when tightened. This feature is critical to the operation of the tether system and it can be appreciated that the several straps connected in the D-ring can adjust or pivot to equalize the tension in all of them. With the lateral strap located close to the sole as well as parallel and along the outside edge 19 of the sandal flexing of the sole will not significately affect the strap tension in the toe strap unit 21 of the tether system. As a result the wearer is assured the sandal will stay in place whether walking in deep mud, swimming, running or partaking in other similar activities.

In order for the lateral strap 23 to perform its function it must be connected to the heel strap unit 22 to stabilize it so it will function properly. This heel strap unit is composed of two heel posts 30, one on each side of the sole 11 near the heel end 16 of the sandal 10. This is preferably a single strap which is cross threaded between the insole 13 and the outsole 12 before they are laminated so one post emerges near the inside edge 18 and the other near the outside edge 19. Each of the distal ends of the strap terminate in an attached triangle ring 31, which could be circular if desired. These heel posts are about one inch in height so the triangle rings will be below the bones in the ankle to avoid irritation.

Connected between the aft bars of the two space apart triangle rings 31 is a heel strap 32 which is best shown in FIG. 1. One end is looped and sewn together around the aft bar of the ring associated with the outside edge 19 with the distal end 33 passed through the other ring. Like the toe strap this heel strap includes an elongated hook patch 34 on the free end and an elongated loop patch 35 in the central portion, as shown in FIG. 1, so the strap can be adjusted to infinite positions by cinching it and forcing the two patches together to retain it in the position selected.

Similar to the heel strap 32, an instep strap 36 is also connected between the triangle rings 31 located at the top of the heel posts 30 but extends forwardly of these posts as can be seen in FIG. 1. One end of the instep strap is looped about one of the bars of the triangle ring of the post on the outside edge 19 and then sewn to the strap. The distal end 37 is passed through the other triangle ring and folded back against itself. Like the heel strap the instep strap uses hook and loop fasteners. The distal end includes an elongated hook patch 38 and the central portion includes an elongated loop patch 39 which lock together when these patches are pressed together, as previously described.

Connected to the instep 36 adjacent to its fixed connection to the triangle ring 31 is the lateral strap 23. It can be appreciated because the heel post 30 is adjacent to the outside edge 19 of the sandal 10 and is close to the sole 11, once the heel strap 32 and the instep strap 36 have been cinched down by the wearer the end of the lateral strap connected to the heel unit 21 is stabilized and strap tension in tether system 20 will thereafter be maintained essentially constant as the sole is flexed during use.

Having described my invention, I claim:

1. In a sport sandal having an elongated sole configured to the profile of a human foot and having a toe end and a heel end along with an insole and an outsole, a special tether strap system for retaining said sole on a human foot comprising;

a toe strap unit extending transversely across said toe end of said insole, and toe strap unit having an extending toe post attached to one side of said insole at its outer edge which terminates in an attached first pivot means located above said insole and a toe strap anchored in said insole on the opposite side of said insole at said toe end and which is threadable through said first pivot means, said toe strap unit having means operable to adjust its length;

a heel strap unit having spaced apart, extending heel posts connected to said insole at its edges adjacent to said heel end of said sole, each of said posts terminating in a separate second pivot means above said insole and a heel strap having one end attached to one of said second pivot means and loopable through the other of said second pivot means with means operable to adjust its length, said heel strap unit also having an instep strap attached to said one of said second pivot means and loopable through the other second pivot means with means to adjust its length whereby said heel strap and said instep strap are operable to encircle a user's ankle when said sandal is in use; and a tether strap having one end connected to said first pivot means on said toe post and disposed parallel and above the outside edge of said sandal, said tether strap having its other end connected to said instep strap adjacent to the latter's attachment to said second pivot means and operable to cause the tension in said toe strap unit and said heel strap unit to dependently change as tension on said straps changes in said toe strap unit and said heel strap unit when the sandal is in use.

2. The device defined in claim 1 wherein the first pivot means and second pivot means are formed with rings.

3. The device defined in claim 2 wherein the means operable to adjust the strap length for each is formed with hook and loop patches on said straps.

* * * * *